US005662387A

United States Patent [19]

Bartkowiak

[11] Patent Number: 5,662,387

[45] Date of Patent: Sep. 2, 1997

[54] CUTTER HEAD AND METHOD FOR MINING HARD ROCK

[76] Inventor: James A. Bartkowiak, 1701 Taxville Rd., Apt. 16C, York, Pa. 17404

[21] Appl. No.: 555,061

[22] Filed: Nov. 8, 1995

[51] Int. Cl.[6] ..... E21C 25/10; E21C 27/12

[52] U.S. Cl. ..... 299/55; 299/78; 299/79.1

[58] Field of Search ..... 299/39.3, 39.4, 299/39.8, 60, 63, 78, 79.1; 175/434, 55

[56] References Cited

U.S. PATENT DOCUMENTS

| | | | |
|---|---|---|---|
| 551,962 | 12/1895 | Henderson | 37/343 |
| 805,685 | 11/1905 | Swanson | 299/39.3 |
| 1,791,865 | 2/1931 | Fordyce | 299/39.9 |
| 2,415,217 | 2/1947 | Osgood | 299/78 X |
| 2,643,106 | 6/1953 | McGowan | 299/78 X |
| 2,730,344 | 1/1956 | Cartlidge | 299/78 |
| 2,738,966 | 3/1956 | Davis | 299/41.1 |
| 2,745,652 | 5/1956 | Kraft | 299/57 |
| 2,751,206 | 6/1956 | Joy | 299/33 |
| 2,792,204 | 5/1957 | Cartlidge | 299/64 |
| 2,808,253 | 10/1957 | Miller | 299/76 |
| 2,811,341 | 10/1957 | Robbins | 299/85.1 |
| 3,036,821 | 5/1962 | Letts | 299/55 |
| 3,074,701 | 1/1963 | Moon | 299/57 |
| 3,139,148 | 6/1964 | Robbins | 175/336 |
| 3,301,600 | 1/1967 | Pirrie et al. | 299/33 |
| 3,358,782 | 12/1967 | Bechem | 175/344 |
| 3,451,721 | 6/1969 | Highberg et al. | 299/39.8 |
| 3,545,811 | 12/1970 | Montacie | 299/56 |
| 3,709,308 | 1/1973 | Rowley et al. | 175/434 |
| 3,958,832 | 5/1976 | Sigott et al. | 299/87.1 |
| 4,192,556 | 3/1980 | Grandori | 299/56 |
| 4,193,637 | 3/1980 | Spencer | 299/56 |
| 4,448,269 | 5/1984 | Ishikawa et al. | 175/335 |
| 4,647,112 | 3/1987 | Demoulin et al. | 299/81.2 |
| 4,784,438 | 11/1988 | Fikse | 299/110 |
| 4,930,487 | 6/1990 | Younger | 125/15 |
| 5,197,453 | 3/1993 | Messina | 125/15 |
| 5,378,049 | 1/1995 | Fleischhaker et al. | 299/101 |

OTHER PUBLICATIONS

Robbins Company Brochure (3 pages) (undated).
Joy Manufacturing Company Annual Report (undated).

*Primary Examiner*—David J. Bagnell
*Attorney, Agent, or Firm*—Webb Ziesenheim Bruening Logsdon Orkin & Hanson, P.C.

[57] ABSTRACT

A cutter head for use in the removal of hard rock. The cutter head combines a standard cutting member, such as button bits or wedge-lock cutters, with cutting blades having a diamond cutting surface. The cutting blades cutting surface is positioned above the standard cutting members so that in operation, the cutting blades form grooves in the rock face and the standard cutting members fracture the rock adjacent the grooves through tensile forces.

6 Claims, 4 Drawing Sheets

CUTTER HEAD AND METHOD FOR MINING HARD ROCK

BACKGROUND OF THE INVENTION

1) Field of the Invention

This invention relates to rock boring machines and, in particular, to a new cutter head construction for such a machine.

2) Description of the Prior Art

One of the challenges facing the mining industry today is the development of a mechanical miner for hard rock mining that is both effective and mobile. This challenge arises from the increasing costs of labor, supplies, and environmental effects. Current hard rock mining methods are expensive and slow.

Current mechanical miners can be classified into two groups: continuous miners and boring machines. Continuous miners employ a drum-type cutter with drag bits. Although continuous miners are mobile and effective in soft rock such as coal, they cannot cut hard rock such as limestone and quartzite. Some examples of these types of miners are disclosed in U.S. Pat. Nos. 2,792,204 and 2,808,253. Boring machines use a rotary cutter with disc cutters or button bits. Boring machines are effective in hard rock, but are very immobile. Two examples of boring machines are Tunnel Boring Machines (TBM) and raise borers (see U.S. Pat. Nos. 3,139,148; 4,192,556; 4,193,637; and 4,784,438).

The most important factor in mechanical mining is the compressive strength of the rocks. The higher the compressive strength of the rock, the harder it is to mine. The basic cutting action of mechanical miners is for the bit to penetrate the rock by using compressive forces to break it down, and then shearing off pieces of rock as the cutter head rotates. Therefore, the success or failure of a mechanical miner hinges on whether or not it can overcome the compressive strength of the rock. This is the reason why present hard rock borers are very large and immobile. Their size enables them to put forth a very large thrust force which is needed to overcome rocks with compressive strengths from 15,000 psi to 40,000 psi. The immobility of these boring machines renders these machines ineffective and impractical in conventional, labor intensive drill and blast methods.

Since rocks are significantly weaker in tension than they are in compression, an important factor for successful hard rock mechanical mining is to break rocks using tensile forces, not compressive forces. For example, even when blasting, rocks must be subjected to tensile forces. This is accomplished by strategically placing bore holes on a rock face which are not loaded with explosives and by delaying the detonation of the placed explosives. Hence, the cost to mine hard rock is extremely costly and dangerous.

Therefore, it is an object of my invention to provide a hard rock mining apparatus to overcome the conventional, labor intensive, drill and blast methods.

It is a further object of my invention to provide a hard rock mining apparatus which safely and economically mines hard rock.

SUMMARY OF THE INVENTION

The objects are achieved by addressing the question of how to create a void in the rocks without requiring large compressive forces. The answer lies in using a combination of cutting tools on the cutter head so as to first form a void or groove on the rock face by a cutting blade and then crushing adjacent rocks by a plurality of bits. Preferably, the blade extends approximately 1 inch to 2½ inches beyond the bits. Using this combination, the primary breaking forces on the rocks are tensile forces.

The cutter head includes a rotating member adapted to be rotated about a longitudinal axis, a first cutting member and a second cutting member. The first cutting member is attached to the rotating member extending outwardly from an outer surface of the rotating member. The second cutting member is attached to the rotating member extending outwardly from the outer surface. A portion of the cutting surface of the second cutting member is positioned farther away from the rotating member outer surface than the first cutting member. The cutter head is driven by a mining or a boring machine.

The rotating member can be a cylindrical-shaped drum or circular-shaped. Preferably, the cutting surface of the second cutting member includes a material having a hardness of 9 or greater on the Mohs scale. The second cutting member can be a blade having a cutting surface that includes diamonds, aluminum oxide and/or cubic boron nitride. The first cutting member can be a cutting bit or a disc-type cutter.

My invention is also a method for mining hard rock and includes the steps of: (a) placing the cutter head in close proximity to a rock face; (b) rotating the cutter head about a longitudinal axis; (c) forcing the rotating cutter head into the rock face of the rock seam; (d) forming spaced apart grooves in the rock seam by the second cutting member rotatably about the longitudinal axis; and (e) breaking away portions of the rock seam positioned between the grooves by the first cutting member that are rotated about the longitudinal axis.

DESCRIPTION OF THE PREFERRED EMBODIMENTS

Figure 1:
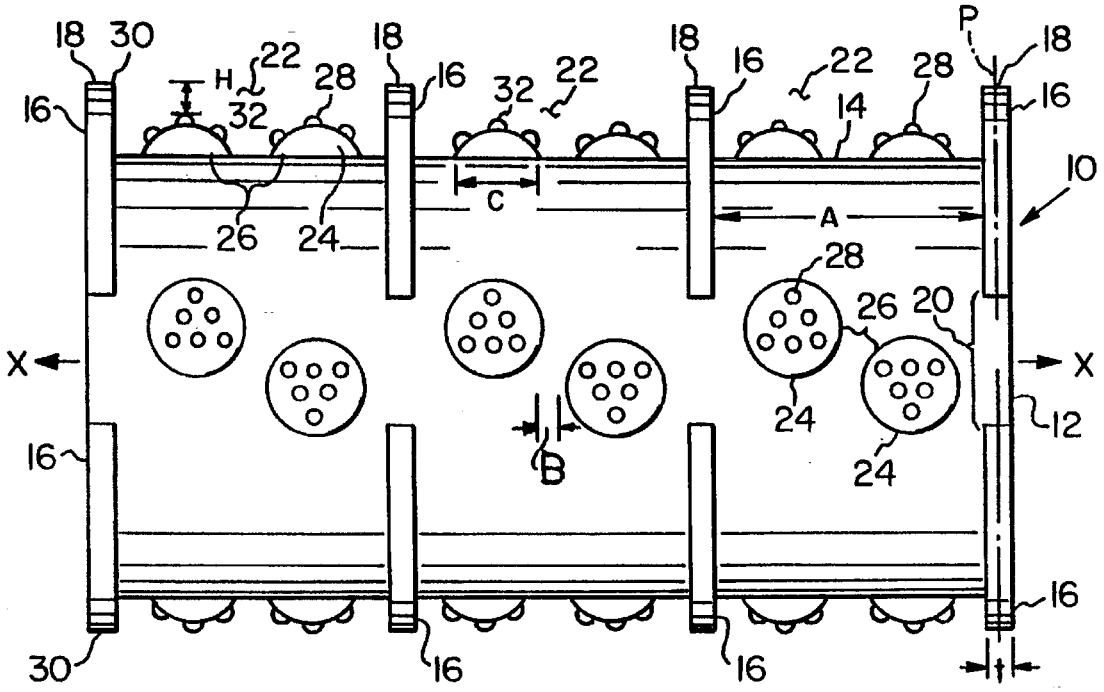
FIG. 1 is a front elevational view of a drum-type cutter off continuous mining machine, made in accordance with the present invention, including blades and cutter bits.

FIG. 1 shows a drum-type cutter head 10, made in accordance with the present invention. Drum-type cutter heads and their related apparatus, in general, are disclosed in U.S. Pat. Nos. 2,808,253 and 2,792,204, which are hereby incorporated by reference. The drum-type cutter head 10 includes a substantially cylindrical-shaped drum 12 having an outer cylindrical surface 14. The drum 12 is journaled to a driving mechanism, i.e., a chain and sprocket arrangement which is well-known in the art, so that the drum 12 can rotate about a central axis X passing through the drum 12. A plurality of cutting blades 16 are secured to the drum 12 and extend outwardly from surface 14. Blades 16 preferably have a cutting surface 18 that includes diamonds, aluminum oxide ($Al_2O_3$), cubic boron nitride (cBN) or any other material preferably having a hardness of about 9 or greater on the Mohs scale. Most preferably, the cutting surface 18 is impregnated with diamonds.

Preferably, the blades 16 are spaced evenly apart a distance A along the axial X direction and respective sets of blades are spaced 180° apart. The blade 16 can also be spaced at different intervals depending on the number of blades used. Preferably, sets of blades 16 are provided on opposite ends of the drum 12 as shown in FIG. 1. Preferably, the blade thickness "t" is as thin as possible for reasons as will be explained later, most preferably one-half inch or less. A crushing region 22 is defined between adjacent axially spaced blades 16.

A plurality of cutting members 24 are attached to the drum 12 and positioned in the respective crushing regions and extend outwardly from surface 14. Preferably, the cutting members 24 are provided in sets 26, which are spaced apart approximately 90° apart in the circumferential direction. The sets 26 can also be spaced apart in different intervals. Preferably, each set 26 includes two cutting members 24 which are slightly offset in the circumferential direction. The cutting members shown in FIG. 1 are hemispherical in shape and have tungsten carbide cutting bits 28, which define a cutting surface. Preferably, the cutting bits 28 are less hard than the cutting surface 18, although the cutting bits can also be made of the same material as surface 18, thereby having the same hardness, or the cutting bits can be made of a material that is harder than the surface 18. These cutting bits are well-known in the art and are generally referred to as button bits and are manufactured by Boart, Secoroc, Kenroc and Throw Away Bits to name a few. It is important that the apex 30 of the blades 16 extends a distance H in the radial direction from the outer surface 14 above the apex 32 of the cutting member 24, so that a portion of the blade cutting surface is positioned further away from surface 14 than cutting members 24. Preferably, the distance H should be between 1 inch and 2½ inches. Further, preferably the cutting surfaces of each set of blades 20 are contained in a plane P normal to the X axis as shown in phantom in FIG. 1. Preferably, the bases of cutting members 24 are wider than the blade thickness "t". More specifically, the chord "C" is greater than the thickness "t".

Figure 2:
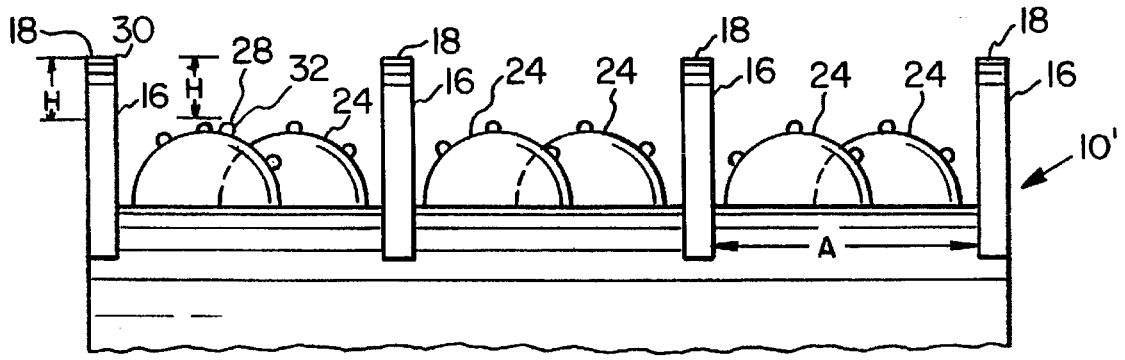
FIG. 2 is a partial front elevational view of a drum-type cutter shown in FIG. 1 similar to that shown in FIG. 1 except for the spacing of the cutter bits.
Figure 3:
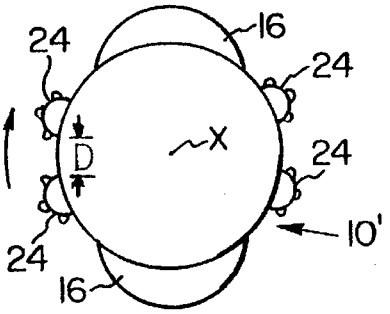
FIG. 3 is a side elevational view of the drum-type cutter shown in FIG. 2.

FIGS. 2 and 3 show a drum cutter head 10', similar to drum cutter head 10, like numerals are used for like elements. The only difference between cutter head 10 and cutter head 10' is the spacing of the cutting members 24. As seen in FIG. 1, a gap B is present in the longitudinal direction with respect to the adjacent cutting members 24. With respect to the embodiment shown in FIGS. 2–4, no gap per se is present about the X axis, however, a gap D is present in the circumferential direction. As can be seen in FIG. 3, the cutting blades 16 are shaped and form lobes 180° apart. Any number of lobes can be provided, which are equally spaced around the drum 12.

Figure 4:
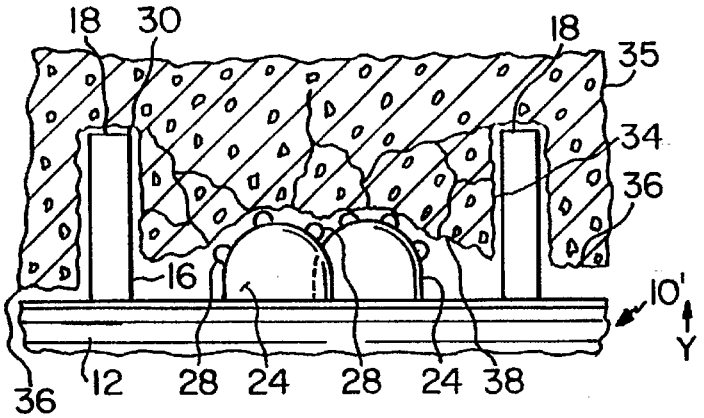
FIG. 4 is a partial sectional front elevational view of a potion of the drum-type cutter shown in FIGS. 2 and 3 cutting rock from a rock face.
Figure 11:
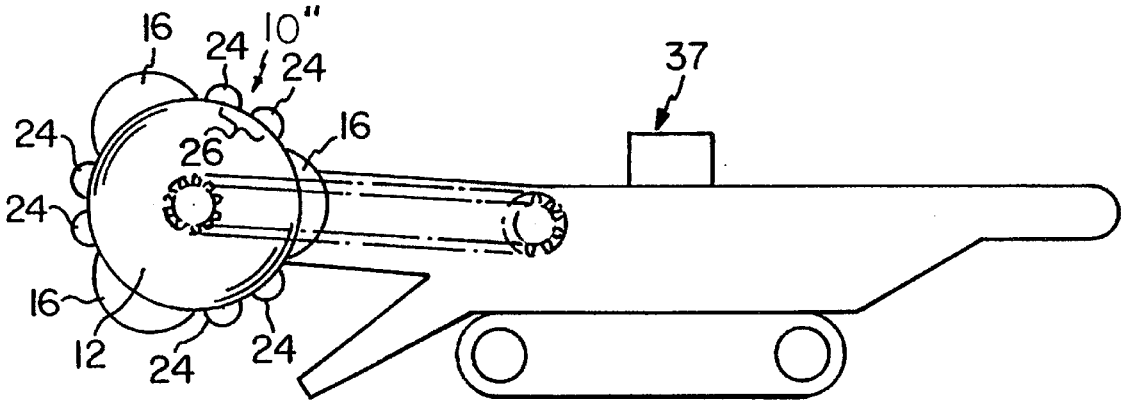
FIG. 11 is a side elevational view showing a continuous miner and a drum-type cutter, made in accordance with the present invention.

In operation, the drum cutter heads 10 or 10' is positioned adjacent to a rock face 36 of a hard rock seam 35. The drum cutter heads 10 or 10' is rotated by an appropriate drive mechanism (not shown) about the X axis, which passes through the drum 12. One type of arrangement is a continuous miner 37 shown in FIG. 11, and includes a drum cutter head 10" similar to drum cutter head 10' shown in FIG. 3 (except three blades are contained in plane P, spaced 120° inch apart) rotatably secured to a continuous miner 37. The drum cutter heads 10, 10' or 10" is forced into the rock face 36 of the hard rock seam 35. The rotating cutting blades 16 cut or form spaced apart grooves 34 in the hard rock seam. As the drum cutter heads 10, 10', or 10" are moved in the Y direction, which is perpendicular to the X axis, the rotating cutting members 24 contact the rock face 36. Continued rotation of the drum cutter heads 10, 10', or 10" causes the cutting bits 28 to pull at an adjacent portion 38 of the rock face positioned between cutting blades 16 and the grooves 34 formed by the blades 16, as shown in FIG. 4. This causes the adjacent portions of rock of the rock seam to fracture and break into pieces. It is believed that the rock fails due to tensile forces aided by stress concentration factors that exist adjacent to the grooves 34. In this manner, the drum cutter heads 10 or 10' more efficiently extracts hard rock than previously possible. This is because the cutter members are removing the hard rock by tensile forces, which are well below the 15,000 psi to 40,000 psi compressive strength of hard rock. As stated previously, the blades 16 should be made as thin as possible, so that a minimum amount of energy is consumed forming the grooves 34. Therefore, a maximum amount of energy of the rotating drum cutter heads 10, 10' or 10" can be used to "pull" the rock bits from the rock face 36 of the rock seam 35. The head is then advanced into the rock seam until it has reached a proper depth.

Under present drill/blast muck methods of mining hard rock, the maximum advance per eight hour shift, is 12 feet in a 10 feet by 10 feet drift at a minimum labor cost of $28.00 per foot and an actual cost of about $350.00 per foot. It is believed that a continuous miner using the drum cutter heads 10 and 10' can mine 40 feet per shift at a maximum labor cost of $23.40 per foot. An advance of 80 feet per shift will result in substantially lower costs.

Additional benefits from using this type of hard rock continuous miner are fewer crusher choke-ups and less power needed because of smaller crusher feeders; better ground control will result because of the lack of blasting damage to the mine walls; and the risk of human life due to mishaps involving the explosives is lowered. Furthermore, scaling time will be greatly reduced adding to lower manpower costs.

Figure 5:
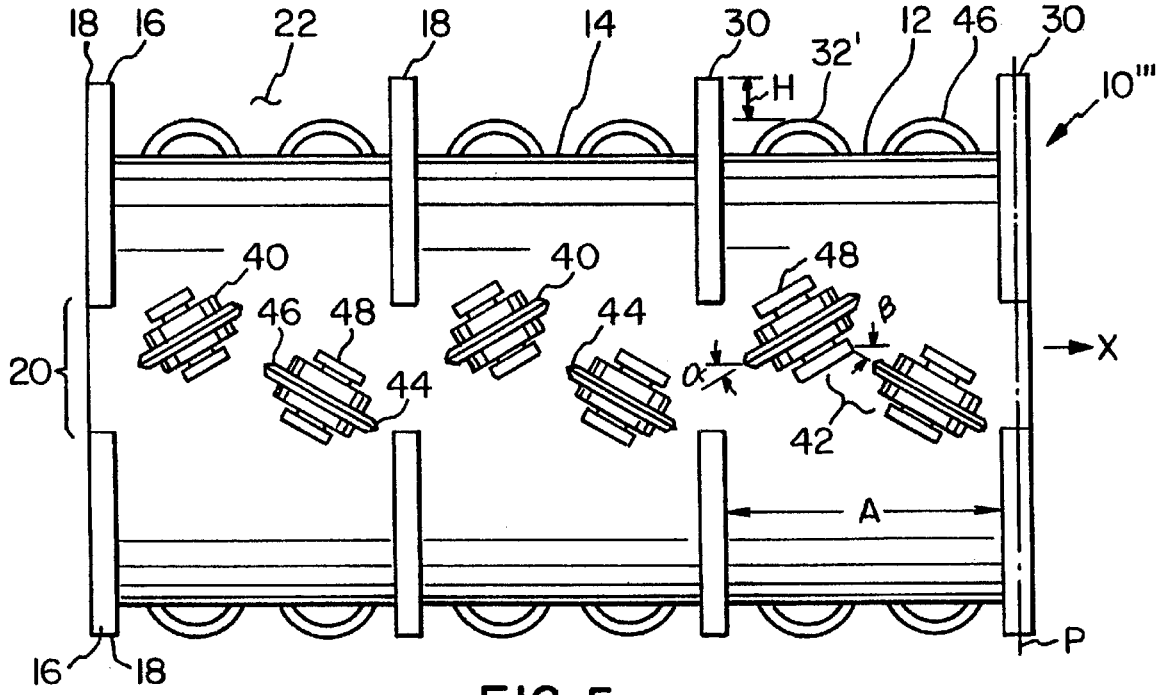
FIG. 5 is a front elevational view of another drum-type cutter, made in accordance with the present invention.

FIG. 5 shows a drum cutter head 10'" similar to drum cutter heads 10, 10' and 10", except the cutting members 24 are replaced by wedge-lock or disc-type cutters 40. The disc-type cutters 40 are provided in staggered sets 42. As seen in FIG. 5, four blade sets 20 are provided defining three crushing regions 22. Four sets 42 of disc-type cutters 40 are provided in each region 22 spaced 90° apart (of which only three sets are shown). Additional sets or less sets can be provided, which can be equally spaced about the drum 12.

The disc-type cutters 40 are well-known in the art and are sold under the trademark "Wedge-Lock" by The Robbins Company of Seattle, Washington (see also U.S. Pat. No. 4,193,637). The cutters 40 include a rotatable disc or blade 44 having a cutting surface 46. The disc is rotatably or pivotally mounted in a block member 48, wherein the block members 48 are mounted or secured to surface 14.

The cutting surfaces 46 are made of tungsten carbide. Like drum cutter heads 10 and 10' it is important that the apex 30 of the blade 16 extends a distance H in the radial direction above the apex 32' of the disc 44 so that a portion of the cutting surface of the cutting blades 16 are positioned further away from surface 14 of the drum 12 than the disc-type cutter 40. As can be seen in FIG. 5, the discs 44 are angled ($\alpha$, $\beta$) with respect to the X axis. It is important that angles $\alpha$ and $\beta$ are not 90° so that the discs 44 are parallel to blades 16. Operation of drum cutter head 10''' is similar to that of drum cutter heads 10, 10' and 10''.

Figure 6:
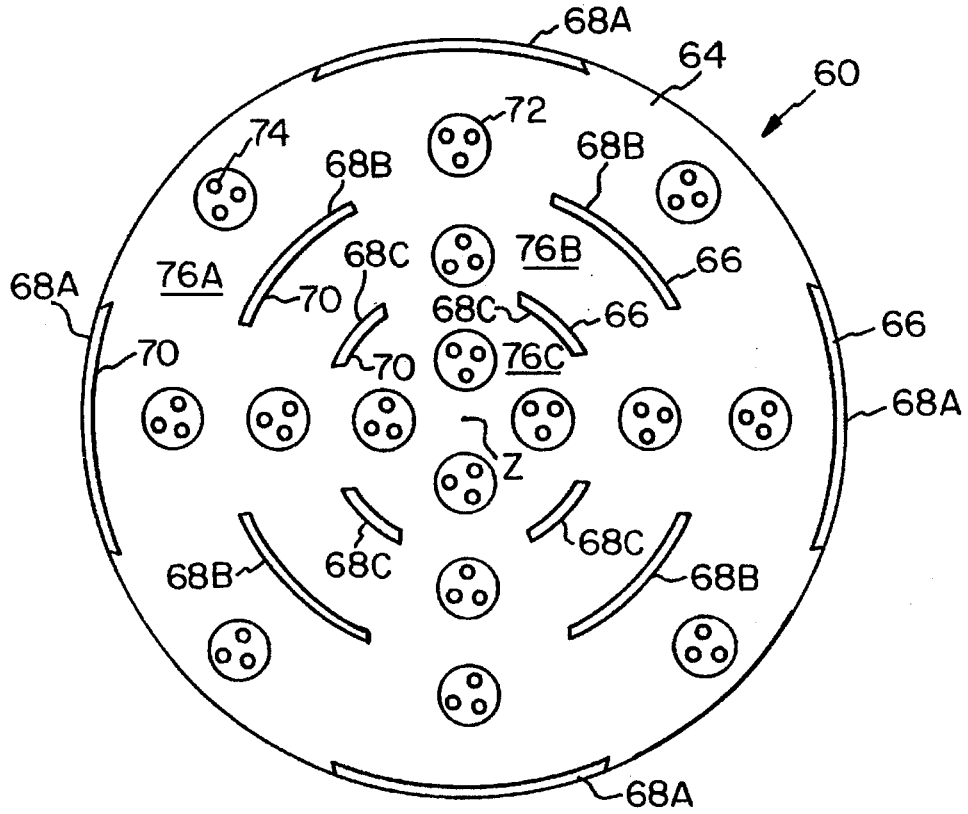
FIG. 6 is a front elevational view of a cutter head of a boring machine, made in accordance with the present invention.
Figure 7:
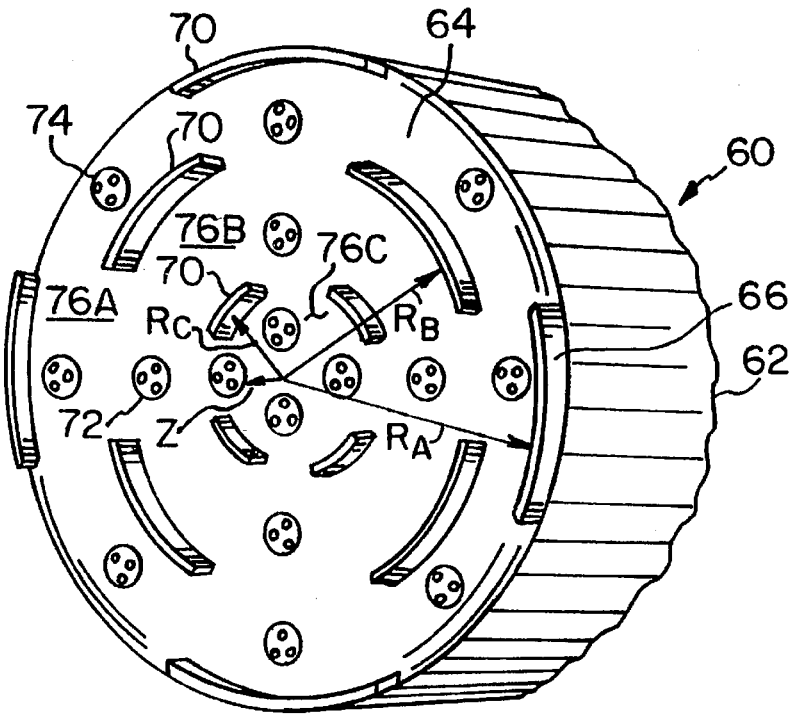
FIG. 7 is a front perspective view of the cutter head and a Portion of a boring machine shown in FIG. 6.
Figure 12:
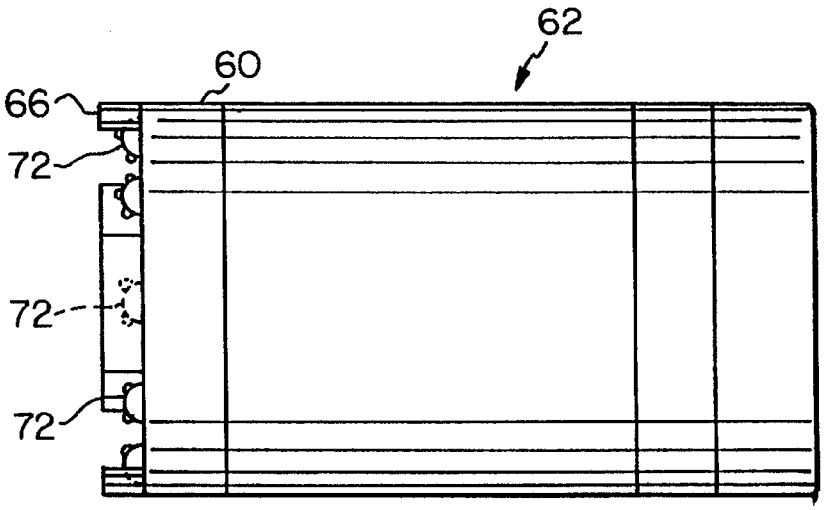
FIG. 12 is a side elevational view of a boring machine and cutter head, made in accordance with the present invention.

FIGS. 6 and 7 disclose a cutter head 60 of a boring machine 62. A profile of a boring machine is shown in FIG. 12 having a cutter head 60 rotatably secured thereto. The boring machine 62, as shown in FIG. 7, absent the head 60, is similar to the type disclosed in U.S. Pat. No. 4,193,637, which is hereby incorporated by reference, and sold by The Robbins Company of Seattle, Washington.

Cutter head 60 is circular-shaped and includes a front surface or face surface 64. A plurality of arcuate cutting blades 66 are attached to the head 60 and extend from and are positioned about the surface 64. As shown in FIGS. 6 and 7, three sets of blades 68A, 68B and 68C are provided. Four blades 66 are provided in each set 68A, 68B and 68C and spaced 90° apart. The blades 66 of each respective set have the same radius ($R_a$, $R_b$, $R_c$) so that they are contained with a respective circle coaxial with a Z axis, which passes through and is normal to the front surface 64. Like cutting blades 16, cutting blades 66 have an upper cutting surface 70 made of diamonds, aluminum oxide ($Al_2O_3$) or cubic boron nitride (cBN) or any other material, preferably having a hardness of about 9 or greater on the Mohs scale. Most preferably, cutting surface 70 is impregnated with diamonds.

Figure 9:
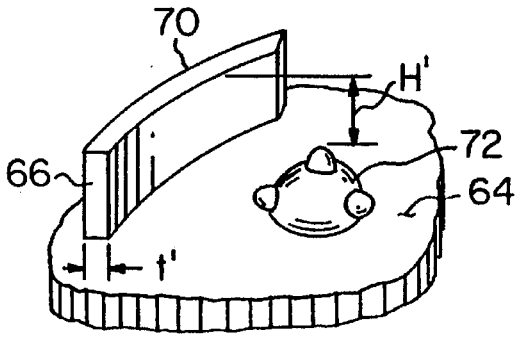
FIG. 9 is a top perspective view of a portion of the cutter head shown in FIGS. 6 and 7.

A plurality of cutting members 72 are secured to the cutter head 60 and extend from and are positioned about the surface 64 and are similar to cutting members 24 and are hemispherical-shaped. Cutting members 72 include cutting bits 74 having cutting surfaces made of tungsten carbide. Preferably, the cutting surfaces of the cutting bits 74 are made of a softer material than are the cutting surfaces of the blades 66. Annular crushing regions 76A, 76B, and 76C are defined between the sets of blades 68A, 68B and 68C, respectively. The cutting members 72 are spaced within the regions 76A, 76B and 76C and are contained on circles coaxial with the Z axis. The cutting surfaces 70 are extended above the apex of the cutting members 72 a distance H', as shown in FIG. 9, so that at least a portion of the cutting blade surfaces are positioned further away from the front surface 64 than the cutting members 72. Preferably, distance H' is between 1 inch and 2½ inches.

In operation, the cutter head 60 is placed in close proximity to or against a rock face of a rock seam (not shown). The boring machine 62 is activated so that the cutter head 60 rotates about the Z axis. A drive arrangement is provided by the boring machine to rotate the cutter head 60. The rotating cutter head 60 is then forced or pressed into the rock face of the rock seam so that the rotating sets of blades 68A, 68B and 68C cut concentric spaced apart circular grooves in the rock seam. The cutting members 72 then contact the mine face and causes adjacent portions of rock positioned between the grooves to fracture due to tensile failure, as opposed to compressive fracture, in the same manner as previously described for drum cutter heads 10. The drum cutter head is then advanced into the mine seam until a proper depth bore is formed.

Figure 8:
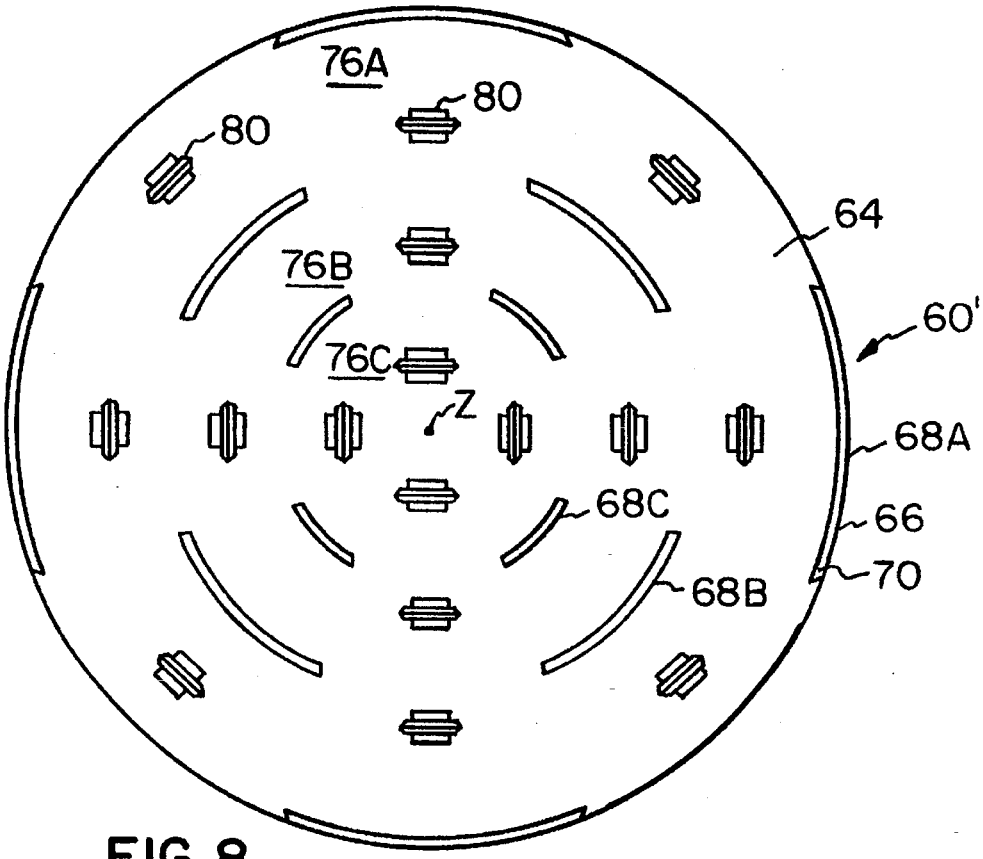
FIG. 8 is a front elevational view of another cutter head similar to that shown in FIG. 6, made in accordance with the present invention.
Figure 10:
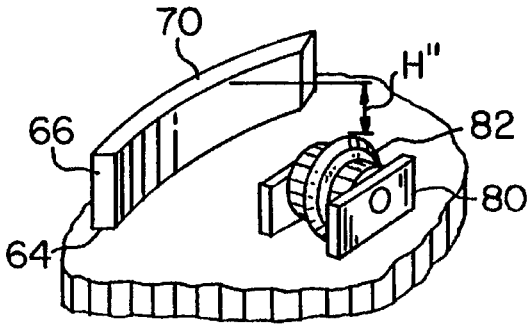
FIG. 10 is a top perspective view of a portion of the cutter head shown in FIG. 8.

FIG. 8 shows a cutter head 60' similar to cutter head 60 with the exception that cutting members 72 are replaced by disc-type cutters 80. Cutters 80 are the same as cutters 40 previously discussed, which cutter 80 includes a circular-shaped cutting blade pivotally secured to a block member secured to the front surface of the cutter head 60'. The cutters 80 are positioned in crushing regions 76A, 76B and 76C. Cutters 80 contained within each region are contained on a circle that is coaxial with the Z axis. As shown in FIG. 10, an apex 82 of the cutter 80 is spaced a distance H" below the cutting surface of the blade 66, preferably between 1 inch and 2½ inches. Cutter head 60' operates in the same manner as cutter head 60.

Like cutting blade 16, it is believed that blades 66 should be as thin as possible having a thickness "t'" of approximately ½ inch or less, thereby utilizing a minimum amount of energy to form the concentric grooves.

It is believed that drum cutter heads 10, 10', 10'' and 10''' and cutter heads 60 and 60' can be used to effectively mine hard rock, such as quartzite, limestone and sulfides. Depending on the properties of the rock, the cutting blades 16 can be designed to be annular discs to fit completely around drum 12 as opposed to the arrangements shown. Likewise, blades 66 can extend 360° so as to be concentric with the Z axis. Cutting elements 24, 40, 72 and 80 can also be substituted with other types of common cutting members, such as drag-type bits which are well-known in the art. It is also believed that the drum cutter heads and cutter heads disclosed will use less energy to mine the hard rock than previous apparatus used to mine hard rock. Although it is believed that the blade cutting surfaces 18 and 70 should be harder than the cutting surfaces of the respective cutting elements 24, 40, 72 and 80, the cutting surfaces of the cutting elements can have the same hardness or be harder than the respective blade cutting surfaces. Hence, the cutting surfaces of the cutting elements can also be made of diamonds, aluminum oxide and/or cubic boron nitride. It is believed that since the button bits, disc-type cutters, and drag-type bits will be used to break rock due to tensile forces, as opposed to compressive forces, they will last longer before they need to be replaced due to wear.

Finally, it should be noted that the drum cutter heads 10, 10', 10'' and 10''' and cutter heads 60 and 60' can be driven by any type of driving arrangement so as to rotate the heads about the appropriate axis as described herein.

Having described the presently preferred embodiments of my invention, it is to be understood that it may otherwise be embodied within the scope of the appended claims.

I claim:

1. A cutter head comprising:

a drum having an outer cylindrical surface, said drum adapted to be rotated about a longitudinal axis passing through said drum;

a plurality of hemispherical-shaped cutting members secured to said drum; and a plurality of blades secured to said drum, wherein said hemispherical-shaped cutting members and said blades extend outwardly from said outer cylindrical surface of said drum, said hemispherical-shaped cutting members including a cutting surface and said blades comprising a cutting surface, at least a portion of said blade cutting surface is positioned further away from said outer cylindrical surface of said drum than said hemispherical-shaped cutting member.

2. A cutter head as claimed in claim 1, wherein said blades having a first thickness and each of said hemispherical-shaped cutting members defining a chord at their base, wherein said blade thickness is less than the hemispherical member chord.

3. A cutter head as claimed in claim 1, wherein said blade includes a cutting surface selected from the group consisting of diamonds, cubic boron nitride and aluminum oxide.

4. A cutter head as claimed in claim 1, wherein said cutting member are staggered about said outer cylindrical surface.

5. A cutter head comprising a circular-shaped rotating member having a face surface, said rotating member adapted to rotate about an axis passing through and normal to said face surface, a plurality of hemispherical-shaped cutting members secured to said rotating member positioned about said face surface and a plurality of blades secured to said rotating member positioned about said face surface, each of said blades extending outwardly from said face surface, each of said hemispherical-shaped cutting members having a cutting surface and each of said blades having a cutting surface, at least a portion of said blade cutting surfaces positioned further away from said face surface than said hemispherical-shaped cutting members.

6. A cutter head as claimed in claim 5, wherein said cutting surface of said blades comprises a material that is harder than said cutting surface of said cutting members.

* * * * *